US012680050B2

(12) United States Patent
Cholli et al.

(10) Patent No.: US 12,680,050 B2
(45) Date of Patent: Jul. 14, 2026

(54) ENVIRONMENTALLY ACCEPTABLE LUBRICANT COMPOSITIONS

(71) Applicant: Polnox Corporation, Lowell, MA (US)

(72) Inventors: Ashok L. Cholli, Chelmsford, MA (US); Murat Tonga, Arlington, MA (US); Sreenivasa Ramana, Lowell, MA (US)

(73) Assignee: Polnox Corporation, Lowell, MA (US)

( * ) Notice: Subject to any disclaimer, the term of this patent is extended or adjusted under 35 U.S.C. 154(b) by 62 days.

(21) Appl. No.: 18/909,317

(22) Filed: Oct. 8, 2024

(65) Prior Publication Data

US 2025/0122443 A1 Apr. 17, 2025

Related U.S. Application Data

(60) Provisional application No. 63/591,037, filed on Oct. 17, 2023.

(51) Int. Cl.

| | |
|---|---|
| ***C10M 169/04*** | (2006.01) |
| ***C10M 133/16*** | (2006.01) |
| ***C10M 145/18*** | (2006.01) |
| ***C10M 161/00*** | (2006.01) |
| *C10N 30/02* | (2006.01) |
| *C10N 30/10* | (2006.01) |
| *C10N 30/18* | (2006.01) |
| *C10N 40/00* | (2006.01) |
| *C10N 40/08* | (2006.01) |

(52) U.S. Cl.

CPC ..... *C10M 169/044* (2013.01); *C10M 133/16* (2013.01); *C10M 145/18* (2013.01); *C10M 161/00* (2013.01); *C10M 2209/10* (2013.01); *C10M 2215/28* (2013.01); *C10N 2030/02* (2013.01); *C10N 2030/10* (2013.01); *C10N 2030/18* (2013.01); *C10N 2040/08* (2013.01); *C10N 2040/135* (2020.05)

(58) Field of Classification Search

CPC ..... C10M 169/044; C10M 133/16; C10M 145/18; C10M 161/00; C10M 2209/10; C10M 2215/28; C10M 169/04; C10N 2030/02; C10N 2030/10; C10N 2030/18; C10N 2040/08; C10N 2040/135

See application file for complete search history.

(56) References Cited

U.S. PATENT DOCUMENTS

| | | | |
|---|---|---|---|
| 7,223,432 | B2 | 5/2007 | Cholli et al. |
| 7,323,511 | B2 | 1/2008 | Cholli et al. |
| 7,507,454 | B2 | 3/2009 | Cholli et al. |
| 7,595,074 | B2 | 9/2009 | Cholli et al. |
| 7,601,378 | B2 | 10/2009 | Cholli et al. |
| 7,678,877 | B2 | 3/2010 | Yang et al. |
| 7,705,075 | B2 | 4/2010 | Kumar et al. |
| 7,705,176 | B2 | 4/2010 | Cholli et al. |
| 7,705,185 | B2 | 4/2010 | Kumar et al. |
| 7,727,571 | B2 | 6/2010 | Cholli et al. |
| 7,754,267 | B2 | 7/2010 | Cholli et al. |
| 7,767,853 | B2 | 8/2010 | Cholli et al. |
| 7,799,948 | B2 | 9/2010 | Kumar et al. |
| 7,902,317 | B2 | 3/2011 | Kumar et al. |
| 7,923,587 | B2 | 4/2011 | Cholli |
| 7,956,153 | B2 | 6/2011 | Cholli et al. |
| 8,008,423 | B2 | 8/2011 | Kumar et al. |
| 8,039,673 | B2 | 10/2011 | Cholli et al. |
| 8,080,689 | B2 | 12/2011 | Kumar et al. |
| 8,242,230 | B2 | 8/2012 | Cholli et al. |
| 8,252,884 | B2 | 8/2012 | Kumar et al. |
| 8,481,670 | B2 | 7/2013 | Kumar et al. |
| 8,598,382 | B2 | 12/2013 | Cholli et al. |
| 8,691,933 | B2 | 4/2014 | Kumar et al. |
| 8,710,266 | B2 | 4/2014 | Kumar et al. |
| 8,846,847 | B2 | 9/2014 | Cholli et al. |
| 8,927,472 | B2 | 1/2015 | Cholli et al. |
| 9,193,675 | B2 | 11/2015 | Cholli et al. |
| 9,388,120 | B2 | 7/2016 | Kumar et al. |
| 9,523,060 | B2 | 12/2016 | Cholli et al. |
| 9,950,990 | B2 | 4/2018 | Cholli et al. |
| 10,294,423 | B2 | 5/2019 | Cholli et al. |
| 10,683,455 | B2 * | 6/2020 | Cholli ..... C07D 251/34 |
| 11,060,027 | B2 | 7/2021 | Cholli et al. |
| 11,578,285 | B2 | 2/2023 | Cholli et al. |

(Continued)

FOREIGN PATENT DOCUMENTS

| | | | |
|---|---|---|---|
| WO | 03087260 | A1 | 10/2003 |
| WO | 2005070974 | A2 | 8/2005 |
| WO | 2005071005 | A1 | 8/2005 |
| WO | 2006014605 | A2 | 2/2006 |
| WO | 2006014674 | A2 | 2/2006 |
| WO | 2006060800 | A1 | 6/2006 |
| WO | 2006060801 | A2 | 6/2006 |

(Continued)

OTHER PUBLICATIONS

Cholli, A., Development of Hydropower Environmentally Acceptable Lubicants (HEALs TM), presented at Clean Currents, National Hydropower Association (Oct. 18, 2022).

*Primary Examiner* — Ellen M Mcavoy

(74) *Attorney, Agent, or Firm* — Hamilton, Brook, Smith & Reynolds, P.C.

(57) ABSTRACT

Compositions comprise first antioxidants and first additives, such as surface, performance-enhancing, lubricant protective, and optionally second and/or second antioxidants. The compositions are useful for improving environmentally acceptable lubricants, lubricant oils, and other lubricant materials. The compositions and methods generally provide longer shelf lives, increased oxidative resistance, improved quality, and/or enhanced performance to lubricants, lubricant oils, hydraulic fluid, and turbine oils.

29 Claims, No Drawings

(56) References Cited

U.S. PATENT DOCUMENTS

| | | | |
|---|---|---|---|
| 2003/0230743 | A1 | 12/2003 | Cholli et al. |
| 2004/0214935 | A1 | 10/2004 | Cholli et al. |
| 2005/0238789 | A1 | 10/2005 | Cholli et al. |
| 2006/0029706 | A1 | 2/2006 | Cholli et al. |
| 2006/0041087 | A1 | 2/2006 | Cholli |
| 2006/0041094 | A1 | 2/2006 | Cholli |
| 2006/0128929 | A1 | 6/2006 | Yang et al. |
| 2006/0128930 | A1 | 6/2006 | Dhawan et al. |
| 2006/0128931 | A1 | 6/2006 | Kumar et al. |
| 2006/0128939 | A1 | 6/2006 | Kumar et al. |
| 2006/0189824 | A1 | 8/2006 | Kumar et al. |
| 2006/0233741 | A1 | 10/2006 | Kumar et al. |
| 2007/0106059 | A1 | 5/2007 | Cholli et al. |
| 2007/0135539 | A1 | 6/2007 | Cholli et al. |
| 2007/0149660 | A1 | 6/2007 | Kumar et al. |
| 2007/0154430 | A1 | 7/2007 | Cholli et al. |
| 2007/0154608 | A1 | 7/2007 | Cholli et al. |
| 2007/0154720 | A1 | 7/2007 | Cholli et al. |
| 2007/0161522 | A1 | 7/2007 | Cholli et al. |
| 2008/0249335 | A1 | 10/2008 | Cholli et al. |
| 2008/0293856 | A1 | 11/2008 | Kumar et al. |
| 2008/0311065 | A1 | 12/2008 | Cholli |
| 2009/0184294 | A1 | 7/2009 | Cholli et al. |
| 2010/0084607 | A1 | 4/2010 | Cholli et al. |
| 2010/0305251 | A1 | 12/2010 | Kumar et al. |
| 2010/0305361 | A1 | 12/2010 | Cholli et al. |
| 2011/0040125 | A1 | 2/2011 | Kumar et al. |
| 2011/0282098 | A1 | 11/2011 | Cholli et al. |
| 2012/0004150 | A1 | 1/2012 | Cholli et al. |
| 2012/0071596 | A1 | 3/2012 | Kumar et al. |
| 2012/0123145 | A1 | 5/2012 | Cholli et al. |
| 2012/0142968 | A1 | 6/2012 | Kumar et al. |
| 2013/0041171 | A1 | 2/2013 | Cholli et al. |
| 2013/0072586 | A1 | 3/2013 | Kumar et al. |
| 2013/0130955 | A1 | 5/2013 | Cholli et al. |
| 2014/0011901 | A1 | 1/2014 | Kumar et al. |
| 2014/0014880 | A1 | 1/2014 | Cholli et al. |
| 2014/0316163 | A1 | 10/2014 | Kumar et al. |
| 2015/0159109 | A1 | 6/2015 | Cholli et al. |
| 2016/0115117 | A1 | 4/2016 | Cholli et al. |
| 2016/0289558 | A1 | 10/2016 | Cholli et al. |
| 2018/0251695 | A1 | 9/2018 | Cholli et al. |
| 2019/0292454 | A1 | 9/2019 | Cholli et al. |
| 2020/0392406 | A1 | 12/2020 | Cholli et al. |
| 2021/0130722 | A1 | 5/2021 | Cholli et al. |
| 2023/0159841 | A1 | 5/2023 | Cholli et al. |

FOREIGN PATENT DOCUMENTS

| | | | |
|---|---|---|---|
| WO | 2006060802 | A1 | 6/2006 |
| WO | 2006060803 | A2 | 6/2006 |
| WO | 2006091705 | A2 | 8/2006 |
| WO | 2006104957 | A2 | 10/2006 |
| WO | 2007050985 | A2 | 5/2007 |
| WO | 2007050987 | A2 | 5/2007 |
| WO | 2007050991 | A1 | 5/2007 |
| WO | 2007064843 | A1 | 6/2007 |
| WO | 2008005358 | A2 | 1/2008 |
| WO | 2015077635 | A2 | 5/2015 |
| WO | 2018160879 | A2 | 9/2018 |

* cited by examiner

ENVIRONMENTALLY ACCEPTABLE LUBRICANT COMPOSITIONS

RELATED APPLICATION

This application claims the benefit of U.S. Provisional Application No. 63/591,037, filed on Oct. 17, 2023. The entire teachings of the above application are incorporated herein by reference.

GOVERNMENT SUPPORT

This invention was made with government support under DE-SC0018876 from the Department of Energy. The government has certain rights in the invention.

TECHNICAL FIELD

This invention generally relates to new and high-performing safer lubricant compositions, lubricant additive packages that apply to bearing oils, steam turbine oils, gas turbine oils, hydro turbine oils, compressor oils, and hydraulic fluids containing minimally toxic additives and environmentally safe biodegradable biobased oils or bio-oils to replace petroleum-based lubricants. The additive packages and formulated lubricant additives are minimally toxic and do not contain any compounds with harmful inorganic species and phosphorous-containing additives. Some additives in the lubricant compositions and additive packages are biobased products. The formulated lubricant oils described herein are comparable to or better than mineral oils in their tested performance while providing environmental safety benefits.

BACKGROUND

The development of non-toxic, eco-friendly biolubricants derived from natural resources or biobased or bio-derived oils as replacements for conventional petroleum-based lubricants is mainly driven by concerns about the effects of (a) waste petroleum lubricants in the environment, namely, soil, air, and water, (b) accidental petroleum oil spillage affecting aquatic life, the environment, and the economy, and (c) the need to achieve independence from imported petroleum. However, for bio-lubricants to reach their full potential to replace petroleum-based lubricants, it is necessary to address the inherently poor thermal-oxidative stability of vegetable-based or bio-derived oils. Bio-lubricant oils are mixed esters of fatty acids (i.e., saturated, monounsaturated, and polyunsaturated). Thus, they possess significantly high unsaturation levels that correlate with increasing oxidative instability. The oxidative instability of bio-lubricants gives rise to several issues during their use, including viscosity changes, formation of deposits, increasing pressure drops across filters, and pump failures. These are slightly polar molecules. In addition to these bio-oils, there are biobased nonpolar saturated hydrocarbon oils. Both types of oils need to meet the criteria for developing formulated environmentally acceptable lubricants (EALs). Environmental standards are established by regulatory agencies, including the U.S. Environmental Protection Agency (US EPA) and the European Chemicals Agency (ECHA) and the associated European Union Regulation on the registration, evaluation, authorisation and restriction of chemicals (REACH). These and other government agencies update their regulations as technological and product assessment developments favor a safer environment. Lubricants with biodegradation characteristics, minimal toxicity, and no bioaccumulation are needed to protect against pollution of water, air, and soil. In the early days of EAL development, efforts were made to meet these environmental safety standards using bio-oils like vegetable oils and readily available additives developed for petroleum-based lubricant products, resulting in performance inferior to petroleum products. Bio-oils have poor oxidative stability compared to petroleum base oils. When bio-oils are exposed to heat, light, and/or oxygen, they degrade faster than petroleum oils. Recent advances in biobased oils and developing new and safer additives addressed the oil's poor thermo-oxidative stability, improving the performance of EALs to similar or petroleum-based lubricants. Another significant improvement of additives for EALs is that they show superior performance and are biobased. Formulated, thermo-oxidatively stable, and biodegradable, biobased and stabler base oils and their mixtures with high-performing safer additives provide EALs, biolubricants to replace ecologically hazardous fossil fuel lubricants with similar performance. Petroleum-based lubricants generally do not contain unsaturated fatty elements, and so possess scarce levels of unsaturation. As a result, they exhibit superior oxidative stability vs. bio-lubricants containing unsaturated carbon content. The performance gap between petroleum and biobased lubricants is narrowed significantly due to new developments.

Essentially, lubricants have base oil or a mixture of base oils and additives. There are many types of chemical additives mixed into base oils to: (a) enhance the properties of the base oil, (b) suppress undesirable properties, and (c) provide desired properties to the base oil depending on application requirements. Not all types of additives are necessary for all lubricant formulations. These additives are selected and treated at a particular level, anywhere from 0.01% to 25% by weight of the base oil, to enhance existing base oil properties with antioxidants, corrosion inhibitors, antifoaming agents, and demulsifiers; suppress undesirable base oil properties with pour-point depressants and viscosity index modifiers; and impart new properties to base oils with extreme pressure additives, metal deactivators, and tackiness agents. Many commercial and conventional synthetic additives have initially been designed and optimized for formulating lubricants to address the need for petroleum-based oils to improve their thermo-oxidative stability and other required performance attributes without regard to their ecological properties like toxicity.

Many synthetic antioxidant additives are superior to naturally occurring antioxidants. Naturally occurring antioxidants are unsuitable for bio-oils or biobased lubricants to perform excellently in industrial applications.

Several technical problems have been found to limit the utility of conventional antioxidants such as dioctyl diphenylamine (DODP), alkylated phenyl-α-naphthylamine (APANA), tertiary butylhydroquinone (TBHQ), butylated hydroxyanisole (BHA), 2,6-Di-tert-butyl-4-methylphenol (BHT), and other antioxidant compounds when used to enhance the oxidative stability of bio-lubricants. The most serious of these technical issues include:

1) The sacrificial nature of existing conventional antioxidants, meaning that once having reacted to scavenge a free radical, they are no longer capable of functioning as antioxidants, and
2) The need for more reactivity of existing conventional antioxidants to efficiently scavenge the highly reactive free radical intermediates that propagate the oxidation chains in polyunsaturated oils.
3) Aqua-toxicity issue in industrial applications.

4) Solubility issues. The additives may only function if they are homogeneously soluble in oils at desired treatment levels.

As a result of these technical issues, conventional synthetic antioxidants are thus relatively ineffective for stabilizing vegetable base oils or bio-lubricants derived from them for use in many industrial applications. This is because the molecular designs of traditional and current commercial antioxidants were developed based on the needs of relatively low unsaturation petroleum-based lubricants. However, many bio-lubricants have relatively high unsaturation, which causes oxidative instability.

To avoid the foregoing technical problems, Cholli et al. describes a "dual-type moiety per molecule" (DTMPM) technology to provide superior oxidative stability to bio-lubricants vs. state-of-the-art commercial antioxidants [EP 14809251.3, U.S. Pat. No. 10,294,423 B2]. The DTMPM technology platform uses different functional groups interacting via a unique regenerative mechanism to extend the useful life of the antioxidant. The antioxidants based on this technology have been molecularly engineered using highly reactive functional groups to scavenge free radicals more efficiently and provide more effective oxidation inhibition. Additional potential benefits from this improved oxidative stability include enabling bio-lubricants at higher-performance applications from which they are currently excluded and enabling the less oxidatively stable oil to substitute for more stable oils in some bio-lubricant applications.

Cholli et al. have also described another additive technology called macromolecular corrosion inhibitor technology (MCIN) platform that is equally suitable for bio-oils, biobased oils, and biolubricants [WO 2018/160879 A2; U.S. Pat. No. 11,578,285 B2]. These additives use safer and biobased chemicals while synthesizing these compounds resulting in a safer product and providing excellent protection against the corrosion of metals.

SUMMARY

To replace toxic petroleum-based lubricants successfully, biolubricant formulated base oils and additives need to (a) be safer so that toxicity effects can be minimized, and (b) perform better than or similar to petroleum-based lubricants.

The benefits of the innovative, safer macromolecular corrosion inhibitor (MCIN) additives meet the regulators' environmental properties and help reduce the number of chemicals needed during lubricant formulations without compromising the performance and cost benefits to the formulators. These additives fall into the chemical use reduction efficiency (CURE). This embodiment uses fewer chemicals in the biolubricants formulation by replacing multiple additives with one safer additive, reducing the total amount of chemical additives needed.

In one embodiment, the formulations of lubricants comprising thermo-oxidatively stable bio-based bio-oils, bio-derived polar and nonpolar base oils, synthetic biodegradable oils, or the mixture thereof, with biobased and other safer additives address the need for lubricants with performance similar to petroleum-based toxic lubricants.

In one embodiment, an unexpectedly superior performance of the formulated lubricant product with additives selected from Polnox's DTMPM technology-based antioxidants and biobased macromolecular corrosion inhibitor (MCIN) with other non-toxic additive products show performance excellent or better compared to toxic petroleum-based products yet being biodegradable, minimally toxic and non-bioaccumulative. These are compared in Table 3 with commercially available petroleum products for hydro turbines providing safer and biodegradable lubricants.

In another embodiment of the present invention, each component of the lubricant product is minimally toxic, i.e., $LC_{50}$>100 mg/L meets regulatory requirements for minimally toxic (Environmentally Acceptable Lubricant requirements as defined in the Vessel General Permit (VGP), VIDA (Vessel Incidental Discharge Act) and European Union (EU)'s Ecolabel). The formulated lubricant not only meets safety guidelines, but also shows performance similar to or better than petroleum products.

The compositions and methods of the present invention provide increased shelf life, increased oxidative resistance, enhanced performance, and improved quality of lubricants, such as biolubricants and biolubricant oils. Disclosed compositions, in general, provide superior performance as lubricants in high temperatures applications due to the presence of thermally-stable antioxidants with enhanced oxidation resistance. Without wishing to be bound by theory, it is believed that because of the combined synergy of the additives and without antagonistic effects among additives, the compositions described herein have superior oxidation resistance, surface protection, and supplementation with additional performance enhancements. When antagonist interaction occurs among additives, one additive reduces the effect of another additive resulting in poor outcomes. The safer additives used in the formulation contribute several key functions to the formulated lubricant: oxidation resistance, corrosion inhibition, rust inhibition, antiwear performance, dispersant properties, demulsifier, antifoaming, low-temperature flow, and suspending ability.

DETAILED DESCRIPTION OF THE INVENTION

A description of example embodiments follows.

For convenience, certain terms employed in the specification and examples are collected here before describing the present invention. These definitions should be read in light of the remainder of the disclosure and understood by a person of skill in the art. Unless defined otherwise, all technical and scientific terms used herein have the same meaning as commonly understood by a person of ordinary skill in the art.

The articles "a" and "an" are used herein to refer to one or to more than one (i.e., at least one) of the grammatical object of the article. By way of example, "an element" means one element or more than one element.

The terms "comprise" and "comprising" are used in the inclusive, open sense, meaning that additional elements may be included.

The term "including" is used herein to mean "including but not limited." "Including" and "including but not limited to" are used interchangeably.

The term "antioxidant" is art-recognized and refers to any of the various compounds added to substances to reduce the effect of oxidation and the accompanying degradation of properties. Non-limiting examples of substances that utilize antioxidants include oils, paints, coatings, polymers, plastics, gasoline, lubricants, and food products.

The term "oxidation" is art-recognized and refers to any reaction in which one or more electrons are removed from species, thus increasing its valance (oxidation state).

The term "radical" is art-recognized and refers to an atom, molecule, or ion that has at least one unpaired valence electron.

The term "substance" is used herein to mean any physical entity, commonly homogeneous, that occurs in macroscopic amounts.

The term "corrosion" is art-recognized and refers to a naturally occurring phenomenon commonly defined as the deterioration of a material, usually a metal, or an alloy, that results from a chemical or electrochemical reaction with its environment.

The term "metal" is art-recognized and generally refers to any class of substances characterized by high electrical and thermal conductivity, malleability, ductility, and light reflectivity.

The term "alloy" is art-recognized and refers to a metal made by combining two or more metallic elements, especially to give greater strength or resistance to corrosion; normally produced by melting the mixture of ingredients, for example, brass (copper and zinc) and bronze (copper and tin).

The term "rust" is art-recognized and refers to the oxidation of metallic iron to produce brown iron oxide.

The term "anti-corrosion" is art-recognized and refers to combating, inhibiting, or preventing corrosion.

The term "lubricant" (sometimes shortened to "lube") is art-recognized. It refers to a substance that helps reduce friction between surfaces in mutual contact, ultimately reducing the heat generated when the surfaces move and contributing to a better and more efficient mechanism functioning.

The term "lubricant additives" is art-recognized and refers to organic or inorganic compounds dissolved or suspended as solids in oil, typically ranging between 0.1 to 30 percent of the oil volume (or by weight of the oil), to:

(a) enhance the existing base oil properties with antioxidants, corrosion inhibitors, antifoaming agents, and demulsifying agents, (b) suppress undesirable base oil properties with pout-point depressants, viscosity index improvers, and/or (c) impart new properties to base oils with extreme pressure additives, detergents, metal deactivators, and tackiness agents.

The terms "antifoaming agent" and "defoamer" are art-recognized and refer to helping minimize foams in oil and are often used interchangeably. The distinction between an antifoam agent and a defoamer is that a defoamer eliminates the existing foam, while an anti-foamer prevents the formation of more foam. Antifoams are typically added to the oil before foam formation and act to avoid foam formation. The additive group in the antifoaming agent possesses low interfacial tension, which weakens the oil bubble wall and allows the foam bubbles to burst easily.

The term "pour point depressant" is art-recognized and refers to helping the oils flow at lower temperatures.

The term "demulsifier" is art-recognized and refers to preventing the formation of a stable emulsion of water and oil so that water will coalesce and separate more rapidly from oil to be drained out, avoiding corrosion issues.

The term "viscosity index (VI) improver" is art-recognized and refers to combating the tendency of oil thinning at high temperatures. At lower temperatures, it assists in improving the viscosity of a thin oil to be viscous enough to lubricate at operating temperature, helping to improve the viscosity range as a working fluid.

The term "extreme pressure additive" is art-recognized and refers to reacting chemically with metal (e.g., iron) surfaces to form a sacrificial surface film that prevents the welding and seizure of opposing asperities caused by metal-to-metal contact, protecting metal surfaces under high-pressure conditions.

The term "tackiness additive" is art-recognized and refers to high molecular weight polymers selectively dissolved in suitable oil to improve lubricant retention, film thickness, and surface adhesion, preventing dripping and splashing of lubricant during operation.

The term "small molecule" is art-recognized. In certain embodiments, this term refers to a molecule with a molecular weight of less than about 2000 amu, less than about 1000 amu, and even less than about 500 amu.

The term "aliphatic" is art-recognized and includes linear, branched, and cyclic alkanes, alkenes, or alkynes. In certain embodiments, aliphatic groups in the present invention are linear or branched and have from 1 to about 20 carbon atoms.

The term "alkyl" is art-recognized and includes saturated aliphatic groups, including straight-chain alkyl groups, branched chain alkyl groups, cycloalkyl (alicyclic) groups, alkyl substituted cycloalkyl groups, and cycloalkyl substituted alkyl groups. In certain embodiments, a straight chain or branched chain alkyl has about 30 or fewer carbon atoms in its backbone $C_1$-$C_{30}$ for straight chain, $C_3$-$C_{30}$ for branched chain), and alternatively, about 20 or fewer. Likewise, cycloalkyls have from about 3 to about ten carbon atoms in their ring structure, and alternatively, about 5, 6, or 7 carbon atoms in their ring structure. The term "alkyl" also includes halo-substituted alkyls.

The term "amine" and "amino" are art-recognized and include both substituted and unsubstituted amines, e.g., a moiety that the general formulas may represent:

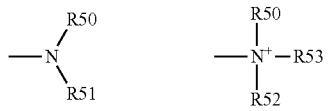

wherein R50, R51, and R52 each independently represent a hydrogen, an alkyl, an alkenyl, —$(CH_2)_m$—R61, or R50 and R51, taken together with the N atom to which they have attached complete a heterocycle having from 4 to 8 atoms in the ring structure; R61 represents an aryl, a cycloalkyl, a cycloalkenyl, a heterocycle or a polycycle; and m is zero or an integer in the range of 1 to 8. In certain embodiments, only one of R50 or R51 may be a carbonyl, e.g., R50, R51, and the nitrogen together do not form an imide. In other embodiments, R50 and R51 (and optionally R52) each independently represent a hydrogen, an alkyl, an alkenyl, or —$(CH_2)$—R61. Thus, the term "alkylamine" includes an amine group, as defined above, having a substituted or unsubstituted alkyl attached thereto, i.e., at least one of R50 and R51 is an alkyl group.

The term "acylamino" is art-recognized and includes a moiety that the general formula may represent:

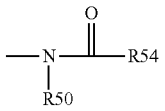

wherein R50 is as defined above, and R54 represents a hydrogen, an alkyl, an alkenyl or —$(CH_2)_m$—R61, where m and R61 are as defined above.

The term "amido" is art recognized as an amino-substituted carbonyl and includes a moiety that the general formula may represent:

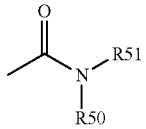

wherein R50 and R51 are defined above. Certain embodiments of the amide in the present invention will not include imides which may be unstable.

The term "carbonyl" is art-recognized and includes such moieties as may be represented by the general formulas:

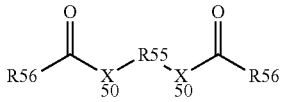

wherein X50 is a bond or represents oxygen or sulfur, and R55 represents a hydrogen, an alkyl, an alkenyl, —$(CH_2)_m$—R61 or an acceptable salt, R56 represents a hydrogen, an alkyl, an alkenyl or —$(CH_2)_m$—R61, where m and R61 are defined above. Where X50 is oxygen and R55 or R56 is not hydrogen, the formula represents an "ester." Where X50 is an oxygen, and R55 is as defined above, the moiety is referred to herein as a carboxyl group, and particularly when R55 is a hydrogen, the formula represents a "carboxylic acid." Where X50 is an oxygen, and R56 is hydrogen, the formula represents a "formate." In general, where the oxygen atom of the above formula is replaced by sulfur, the formula represents a "thiocarbonyl" group. Where X50 is a sulfur and R55 or R56 is not hydrogen, the formula represents a "thioester." Where X50 is sulfur, and R55 is hydrogen, the formula represents a "thiocarboxylic acid." Where X50 is a sulfur, and R56 is hydrogen, the formula represents a "thioformate." On the other hand, where X50 is a bond, and R55 is not hydrogen, the above formula represents a "ketone" group. Where X50 is a bond, and R55 is hydrogen, the above formula represents an "aldehyde" group.

The terms "alkoxyl" or "alkoxy" are art-recognized and include an alkyl group, as defined above, with an oxygen radical attached. Representative alkoxyl groups include methoxy, ethoxy, propyloxy, tert-butoxy and the like. An "ether" is two hydrocarbons covalently linked by an oxygen. Accordingly, the substituent of an alkyl that renders that alkyl an ether is or resembles an alkoxyl, such as may be represented by one of —O-alkyl, —O-alkenyl, —O-alkynyl, —O—$(CH_2)_m$—R61, where m and R61 are described above.

The term "aryl" is art-recognized and includes 5-, 6- and 7-membered single-ring aromatic groups that may include from zero to four heteroatoms, for example, benzene, pyrrole, furan, thiophene, imidazole, oxazole, thiazole, triazole, pyrazole, pyridine, pyrazine, pyridazine and pyrimidine, and the like. Those aryl groups having heteroatoms in the ring structure may also be referred to as "aryl heterocycles," "heteroaryls," or "heteroaromatics." The aromatic ring may be substituted at one or more ring positions with such substituents as described above, for example, halogen, azide, alkyl, aralkyl, alkenyl, alkynyl, cycloalkyl, hydroxyl, alkoxyl, amino, nitro, sulfhydryl, imino, amido, phosphonate, phosphinate, carbonyl, carboxyl, silyl, ether, alkylthio, sulfonyl, ketone, aldehyde, ester, heterocyclyl, aromatic or heteroaromatic moieties, —$CF_3$, —CN, or the like. The term "aryl" also includes polycyclic ring systems having two or more cyclic rings in which two or more carbons are common to two adjoining rings (the rings are "fused rings") wherein at least one of the rings is aromatic, e.g., the other cyclic rings may be cycloalkyls, cycloalkenyls, cycloalkynyls, aryls and/or heterocyclyls.

Analogous substitutions may be made to alkenyl and alkynyl groups to produce, for example, aminoalkenyls, aminoalkynyls, amidoalkenyls, amidoalkynyls, iminoalkenyls, iminoalkynyls, thioalkenyls, thioalkynyls, carbonyl-substituted alkenyls or alkynyls.

The terms ortho, meta, and para are art-recognized and apply to 1,2-, 1,3- and 1,4-disubstituted benzenes, respectively. For example, the names 1,2-dimethylbenzene and ortho-dimethylbenzene are synonymous.

The definition of each expression, e.g., alkyl, m, n, etc., when it occurs more than once in any structure is intended to be independent of its definition elsewhere in the same structure unless otherwise indicated expressly or by the context.

The terms "heterocyclyl" and "heterocyclic group" are art-recognized and include 3- to about 10-membered ring structures, such as 3- to about 7-membered rings, whose ring structures include one to four heteroatoms. Heterocycles may also be polycycles. Heterocyclyl groups include, for example, thiophene, thianthrene, furan, pyran, isobenzofuran, chromene, xanthene, phenoxathiin, pyrrole, imidazole, pyrazole, isothiazole, isoxazole, pyridine, pyrazine, pyrimidine, pyridazine, indolizine, isoindole, indole, indazole, purine, quinolizine, isoquinoline, quinoline, phthalazine, naphthyridine, quinoxaline, quinazoline, cinnoline, pteridine, carbazole, carboline, phenantbridine, acridine, pyrimidine, phenantbroline, phenazine, phenarsazine, phenothiazine, furazan, phenoxazine, pyrrolidine, oxolane, thiolane, oxazole, piperidine, piperazine, morpholine, lactones, lactams such as azetidinones and pyrrolidinones, sultams, sultones, and the like. The heterocyclic ring may be substituted at one or more positions with such substituents as described above, for example, halogen, alkyl, aralkyl, alkenyl, alkynyl, cycloalkyl, hydroxyl, amino, nitro, sulfhydryl, imino, amido, phosphonate, phosphinate, carbonyl, carboxyl, silyl, ether, alkylthio, sulfonyl, ketone, aldehyde, ester, a heterocyclyl, an aromatic or heteroaromatic moiety, —$CF_3$, —CN, or the like.

The terms triflyl, tosyl, mesyl, and nonaflyl are art-recognized and refer to trifluoromethanesulfonyl, p-toluenesulfonyl, methanesulfonyl, and nonafluorobutanesulfonyl groups, respectively. The terms triflate, tosylate, mesylate, and nonaflate are art-recognized and refer to trifluoromethanesulfonate ester, p-toluenesulfonate ester, methanesulfonate ester, and nonafluorobutanesulfonate ester functional groups and molecules that contain said groups, respectively.

The abbreviations Me, Et, Ph, Tf, Nf, Ts, and Ms are art recognized and represent methyl, ethyl, phenyl, trifluoromethanesulfonyl, nonafluorobutanesulfonyl, p-toluenesulfonyl and methanesulfonyl, respectively. A more comprehensive list of the abbreviations utilized by organic chemists of ordinary skill in the art appears in the first issue of each volume of the "Journal of Organic Chemistry"; this list is typically presented in a table entitled Standard List of Abbreviations.

Certain monomeric subunits of the present invention may exist in particular geometric or stereoisomeric forms. In addition, polymers and other compositions of the present invention may also be optically active. The present invention contemplates all such compounds, including cis- and trans-isomers, R- and S-enantiomers, diastereomers, (D)-isomers, (L)-isomers, the racemic mixtures thereof, and other mixtures thereof, as falling within the scope of the invention. Additional asymmetric carbon atoms may be present in a substituent like an alkyl group. All such isomers, as well as mixtures thereof, are intended to be included in this invention.

If, for instance, a particular enantiomer of a compound of the present invention is desired, it may be prepared by asymmetric synthesis or by derivation with a chiral auxiliary, where the resulting diastereomeric mixture is separated and the auxiliary group cleaved to provide the pure desired enantiomers. Alternatively, where the molecule contains a basic functional group, such as amino, or an acidic functional group, such as carboxyl, diastereomeric salts are formed with an appropriate optically active acid or base, followed by resolution of the diastereomers thus formed by fractional crystallization or chromatographic means well known in the art, and subsequent recovery of the pure enantiomers.

It will be understood that "substitution" or "substituted with" includes the implicit proviso that such substitution is by permitted valence of the substituted atom and the substituent, and that the substitution results in a stable compound, e.g., which does not spontaneously undergo transformation such as by rearrangement, cyclization, elimination, or other reaction.

The term "substituted" is also contemplated to include all permissible substituents of organic compounds. In a broad aspect, the permissible substituents include acyclic and cyclic, branched and unbranched, carbocyclic and heterocyclic, and aromatic and nonaromatic substituents of organic compounds. Illustrative substituents include, for example, those described herein above. The permissible substituents may be one or more and the same or different for appropriate organic compounds. For purposes of this invention, the heteroatoms such as nitrogen may have hydrogen substituents and/or any permissible substituents of organic compounds described herein which satisfy the valences of the heteroatoms. This invention is not intended to be limited by the permissible substituents of organic compounds.

The term "hydrocarbon" is art-recognized and includes all permissible compounds with at least one hydrogen and carbon atom. For example, permissible hydrocarbons include acyclic and cyclic, branched and unbranched, carbocyclic and heterocyclic, and aromatic and nonaromatic organic compounds that may be substituted or unsubstituted.

For purposes of this invention, the chemical elements are identified in accordance with the Periodic Table of the Elements, CAS version, Handbook of Chemistry and Physics, 103rd Ed., 2022.

The phrase "protecting group" is art-recognized temporary substituents that protect a potentially reactive functional group from undesired chemical transformations. Examples of such protecting groups include esters of carboxylic acids, silyl ethers of alcohols, and acetals and ketals of aldehydes and ketones, respectively. The field of protecting group chemistry has been reviewed. Greene et al., Protective Groups in Organic Synthesis 2nd ed., Wiley, New York, (1991).

The term "oil" is art-recognized as natural, synthetic, vegetable, animal, petroleum, and plant-based.

The term "bio-oil" or "pyrolysis oil" is art-recognized as a liquid condensate of the vapors of pyrolysis of dried biomass without oxygen at higher temperatures (>428° F.) and can be a substitute for fuels. "bio-oil" also refers to animal fatty acid oils and naturally occurring vegetable oils, e.g., canola, soybean, corn, and castor.

The term "plant-based oil" is art-recognized and refers to oils like Jojoba (Jatropha) oil, coconut oil, and sunflower oil and is mainly used for nonedible oils from plants.

The term "biobased" is art-recognized commercial or industrial products other than food recognized by the U.S. Department of Agriculture composed in whole or a significant part of biological products, forestry materials, or renewable domestic agricultural materials, including plant, animal, or marine materials.

The term "synthetic oil" is art-recognized lubricant consisting of chemical compounds that are artificially modified or synthesized. Synthetic lubricants can be manufactured using chemically modified petroleum components rather than whole crude oil but can also be synthesized from other raw materials. The base material, however, is still overwhelmingly crude oil that is distilled and then modified physically and chemically.

The term "Bio derived oil" or "bio-synthetic oil" is art-recognized products from bio sources like plants, animals, and marine species and further processed or chemically modified using other synthetic or natural chemicals through synthetic means to produce intended for industrial applications, i.e., lubricants and aviation fuels.

Lubricants, lubricant oils, mixtures thereof, and compositions comprising lubricants and lubricant oils can be improved by the methods of the present invention by contacting the lubricant, lubricant oil, combinations thereof, or composition comprising the lubricant or lubricant oil or mixtures thereof with antioxidants, corrosion inhibitors, other additives and mixtures thereof as described herein.

The terms "lubricants" and "lubricant oils" can be used interchangeably. Examples of lubricants suitable for use in the compositions and methods of the present invention include bio-oils, biobased oils, biodegradable oils, synthetic biodegradable oils like polyalphaolefins (also referred to as poly (α-olefins)), biolubricants, polyolesters, vegetable oils, plant oils, those derived from vegetables, for example, from rapeseed, sunflower, palm, and coconut. Biolubricants are often but not necessarily, based on vegetable oils. They can also be synthetic esters or estolides, which may be partly derived from renewable resources. They can be made from various natural sources, including solid fats and low-grade or waste materials such as tallows. They generally offer rapid biodegradability and low environmental toxicity.

The term "environmentally acceptable lubricant (EAL)" is art-recognized, biodegradable, minimally toxic to aquatic organisms, and has no bioaccumulation.

The term "biodegradability" is art-recognized as a measure of microorganisms' breakdown of a chemical (or a chemical mixture). (EPA 800-R-11-002)

The term "primary biodegradation" is art-recognized, the loss of one or more active groups in a chemical compound that renders the compound inactive about a particular function. Primary biodegradation may convert a toxic compound into a less toxic or non-toxic compound. (EPA 800-R-11-002)

The term "ultimate biodegradation" is art-recognized, also referred to as mineralization, is the process whereby a chemical compound is converted to carbon dioxide, water, and mineral salts (EPA 800-R-11-002)

When it comes to operational aspects of biodegradability, there are two types of biodegradability:

1) The term "inherently biodegradable" is art-recognized, the chemical shows evidence of biodegradation in any test for biodegradability.

2) The term "readily biodegradable" is art-recognized to show that some fraction of a compound is ultimately biodegradable within the specific time frame, as a test method specifies. OECD301 B (Organization for Economic Cooperation and Development) and ASTM D 5864 are the test methods that measure "readily" biodegradability 60% of the chemical converts into CO2, within a ten days window following the onset of biodegradation that must occur within 28 days starting of the test. (EPA 800-R-11-002)

The term "aquatic toxicity" or "toxicity" is art-recognized, to demonstrate the material's toxicity to aquatic organisms. It is generally measured by $LC_{50}$ (lethal concentration 50, which is the concentration of a compound or mixture that will kill half of the sample population of a specific test organism in a specified period). Three tests include OCED 201, the 72-hour test for algae (growth inhibition test); OECD202, the 48-hour test for *daphnia* (acute immobilization test); and OECD 203, the 96-hour test for fish (acute test for fish).

The typical values to be both EU and EPA-compliant for fully formulated EAL are the following:

The $LC_{50}$≥100 mg/L for an accidental loss lubricant (ALL), such as completely formulated hydraulic fluid; and LC50≥1000 mg/L for a total loss lubricant (TLL).

These are examples to show that the level of toxicity is dependent on the type of lubricant, accidental loss lubricants (ALL) (hydraulic systems, metal working fluids, closed gear oils), partial loss lubricants (PLL) (use in open gears, stern tube oils, two-stroke engine oils); or total loss lubricants (TLL) (chain saw oils, wire rope lubricants, total loss greases, and other total loss lubricants).

Table 1 shows the European Commission (EC) regulation for Eco Label, EC66/2000.

TABLE 1

EU Regulation for Eco Label, EC 66/2010

| EU Ecolabel criteria for lubricants, Document C(2018) 7125) | | ALL | PLL | TLL |
|---|---|---|---|---|
| Aquatic Toxicity for the Freshly Prepared Lubricant | Critical Concentration for Acute Aquatic Toxicity | >100 mg/L | >1000 mg/L | >1000 mg/L |
| Aquatic toxicity for each main component (5%) | | >10 mg/L | >100 mg/L | >100 mg/L |

Test data on Fish, Daphnia, and Algae, OECD 201, OECD 202, OECD203

ALL, Accidental Loss Lubricants: hydraulic systems, metalworking fluids, closed gear oils PLL, Partial Loss Lubricants.: use in open gears, stern tube oils, two-stroke oils TLL, Total Loss Lubricants Ex. chain saw oils, wire rope lubricants, concrete release agents, total loss greases and other total loss lubricants;

Cumulative mass percentage limits (% w/w) limits for substances present in the product concerning their aquatic toxicity are in Table 2.

TABLE 2

Cumulative mass percentage (% w/w) limits for substances present in the product concerning their aquatic toxicity.

| | Cumulative mass percentage (% weight by weight in the final product) | | |
|---|---|---|---|
| | ALL | PLL | TLL |
| Acute aquatic toxicity >100 mg/l | NOT LIMITED | | |
| Acute aquatic toxicity >10 to ≤100 mg/l | ≤10 | ≤10 | ≤2 |
| Acute aquatic toxicity >1 to ≤10 mg/l | ≤0.25 | ≤0.6 | ≤0.4 |
| Acute aquatic toxicity ≤1 mg/l | ≤0.1/M(*) | ≤0.1/M(*) | ≤0.1/M(*) |

*M-factors for highly toxic components are applied according to Article 10 of Regulation (EC) No 1272/2008, as described in Section 4.1.3.5.5.5 of Annex I ALL, Accidental Loss Lubricants: hydraulic systems, metalworking fluids, closed gear oils PLL, Partial Loss Lubricants.: use in open gears, stern tube oils, two-stroke oils TLL, Total Loss Lubricants Ex. chain saw oils, wire rope lubricants, concrete release agents, total loss greases and other total loss lubricants;

The term "safe" or "safer" is art-recognized and is used interchangeably to describe not exposed to danger or risk; not likely to be harmed by additive chemicals whose aquatic acute toxicity is >100 mg/L, compliant with U.S. EPA or Ecolabel toxicity standard.

It is also art-recognized that naturally occurring antioxidants for lubricants are low-performing and need to meet the expected performance level in industrial lubricant applications. In certain embodiments, safer synthetic antioxidants are the most suitable additive for industrial lubricants to improve oxidation inhibition. The antioxidants suitable to formulate environmentally acceptable lubricants are those with aqua toxicity>100 mg/L, safer antioxidants.

The term "bioaccumulation" is art-recognized, the gradual accumulation of substances, chemicals, and additives in an organism, e.g., an aquatic organism. Bioaccumulation of toxic substances occurs when an organism absorbs a toxic substance faster than that at which the substance is lost or eliminated from the organism. Bioaccumulation can be predicted by toxicokinetic models in some organisms, i.e., fish (Environ Sci Technol. 2012 Mar. 20; 46 (3273-3280).

The term "no bioaccumulation" of a formulated lubricant is art-recognized as one of three requirements to qualify as environmentally acceptable lubricants (EALs). The other two requirements are minimally toxic ($LC_{50}$≥100 mg/L or >1000 mg/L, depending on the type of lubricant, as mentioned earlier) and "readily" biodegradable.

As used herein, certain terms are identified in accordance with the U.S. Environmental Protection Agency (EPA) requirements mentioned in EALs (EPA 800-R-11-002, Vessel General Permit (VGP, 2013)) and/or European Commission (EC) regulation 2018/1702 establishing the European Union (EU) Ecolabel criteria for lubricants.

Additives

Examples of first additives suitable for use in the compositions and methods of the present invention include but are not limited to biobased-surface additives, performance-enhancing additives, and lubricant protective additives.

Surface additives: In certain embodiments of the present invention, surface additives can protect the lubricated surfaces from wear, corrosion, rust, and friction. Examples of these surface additives suitable for use in the compositions and methods of the present invention include but are not limited to (a) rust inhibitors, (b) corrosion inhibitors, (c)

extreme pressure agents, (d) tackiness agents, (e) antiwear agents, (f) detergents and dispersants, (g) compounded oil (like fat or vegetable oil to reduce the coefficient of friction without affecting the viscosity), (h) antimisting, (i) seal swelling agents and (j) biocides.

Performance-Enhancing Additives: In certain embodiments of the present invention, performance-enhancing additives improve the performance of lubricants. Examples of these performance-enhancing additives suitable for use in the compositions and methods of the present invention include but are not limited to (a) pour-point depressants, (b) viscosity index modifiers, (c) emulsifiers, and (d) demulsifiers.

Lubricant Protective Additives: In certain embodiments of the present invention, lubricant protective additives maintain oil quality from oxidation and other thermal degradation processes. Examples of these lubricant protective additives suitable for use in the compositions and methods of the present invention include but are not limited to (a) oxidation inhibitors and (b) foam inhibitors.

Other Lubricant Additives

In certain embodiments, a second additive can be used in the compositions and methods of the present invention in combination with the first antioxidant and the first additive as described above. Examples of second additives suitable for use in the compositions and methods of the present invention include but are not limited to, for example, dispersants, detergents, corrosion inhibitors, rust inhibitors, metal deactivators, antiwear and extreme pressure agents, antifoam agents, friction modifiers, seal swell agents, demulsifiers, viscosity index improvers, pour point depressants, and the like. See, for example, U.S. Pat. No. 5,498,809 for a description of functional lubricating oil composition additives, the disclosure of which is incorporated herein by reference in its entirety.

Dispersants: Examples of dispersants suitable for use in the compositions and methods of the present invention include, but are not limited to, polybutenylsuccinic acid-amides, -imides, or -esters, polybutenylphosphonic acid derivatives, Mannich Base ashless dispersants, and the like.

Detergents: Examples of detergents suitable for use in the compositions and methods of the present invention include, but are not limited to, metallic phenolates, metallic sulfonates, metallic salicylates, metallic phosphonates, metallic thiophosphonates, metallic thiopyrophosphonates, and the like.

Corrosion Inhibitors: Examples of corrosion inhibitors suitable for use in the compositions and methods of the present invention include, but are not limited to, phosphosulfurized hydrocarbons and their reaction products with an alkaline earth metal oxide or hydroxide, hydrocarbyl-thio-substituted derivatives of 1,3,4-thiadiazole, thiadiazole polysulphides and their derivatives and polymers thereof, macromolecular corrosion inhibitors (MCIN) additives, thio and polythio sulphenamides of thiadiazoles such as those described in U.K. Patent Specification 1,560,830, and the like.

Rust Inhibitors: Examples of rust inhibitors suitable for use in the compositions and methods of the present invention include, but are not limited to, macromolecular corrosion inhibitors (MCIN), nonionic surfactants such as polyoxyethylene polyols and esters thereof, anionic surfactants such as salts of alkyl sulfonic acids, and other compounds such as alkoxylated fatty amines, amides, alcohols and the like, including alkoxylated fatty acid derivatives treated with C9 to C16 alkyl-substituted phenols (such as the mono- and di-heptyl, octyl, nonyl, decyl, undecyl, dodecyl, and tridecyl phenols).

Metal Deactivators: Metal deactivators, as used herein, are additives that form an inactive film on metal surfaces by complexing with metallic ions. Examples of metal deactivators suitable for use in the compositions and methods of the present invention include but are not limited to N,N-disubstituted aminomethyl-1,2,4-triazoles, N, N-disubstituted aminomethyl-benzotriazoles, mixtures thereof, and the like.

Antiwear and Extreme Pressure Additives: Antiwear and extreme pressure additives, as used herein, react with metal surfaces to form a layer with lower shear strength than metal, thereby preventing metal-to-metal contact and reducing friction and wear. Examples of antiwear additives suitable for use in the compositions and methods of the present invention include but are not limited to, sulfurized olefins, sulfurized esters, sulfurized animal and vegetable oils, polymeric corrosion inhibitors, macromolecular corrosion inhibitor (MCIN) additives, phosphate esters, organophosphites, dialkyl alkyl phosphonates, acid phosphates, zinc dialkyldithiophosphates, zinc diaryldithiophosphates, organic dithiophosphates, organic phosphorothiolates, organic thiophosphates, organic dithiocarbamates, dimercaptothiadiazole derivatives, mercaptobenzothiazole derivatives, amine phosphates, amine thiophosphates, amine dithiophosphates, organic borates, chlorinated paraffin, and the like.

Antifoam Agents: Examples of antifoam agents suitable for use in the compositions and methods of the present invention include, but are not limited to, polysiloxanes, polymethacrylates, and the like.

Friction Modifiers: Examples of friction modifiers suitable for use in the compositions and methods of the present invention include, but are not limited to, fatty acid esters and amides, organic molybdenum compounds, molybdenum dialkylthiocarbamates, molybdenum dialkyl dithiophosphates, molybdenum dithiolates, copper oleate, copper salicylate, copper dialkyldithiophosphates, molybdenum disulfide, graphite, polytetrafluoroethylene, and the like.

Seal swell agents, as used herein, react chemically with elastomers to cause slight swell, thus improving low-temperature performance, especially in, for example, aircraft hydraulic oil. Examples of seal swell agents suitable for use in the compositions and methods of the present invention include but are not limited to dioctyl sebacate, dioctyl adipate, dialkyl phthalates, and the like.

Demulsifiers: Demulsifiers, as used herein, promote the separation of oil and water in lubricants exposed to water. Examples of demulsifiers suitable for use in the compositions and methods of the present invention include macromolecular corrosion inhibitor (MCIN) additives but are not limited to the esters described in U.S. Pat. Nos. 3,098,827 and 2,674,619 incorporated herein by reference.

Viscosity Index Improvers: Examples of viscosity index improvers suitable for use in the compositions and methods of the present invention include, but are not limited to olefin copolymers, dispersant olefin copolymers, polymethacrylates, vinylpyrrolidone/methacrylate-copolymers, polyvinylpyrrolidones, polybutanes, styrene-acrylate-copolymers, polyethers, and the like.

Pour Point Depressants: Pour point depressants, as used herein, reduce the crystal structure's size and cohesiveness, resulting in a low pour point and increased flow at low temperatures. Examples of pour point depressants suitable for use in the compositions and methods of the present invention include, but are not limited to: polymethacrylates, alkylated naphthalene derivatives, and the like.

One embodiment is a composition for improving lubricants, wherein the composition comprises i) a first antioxidant that is a compound having the following structure:

(Structure I)

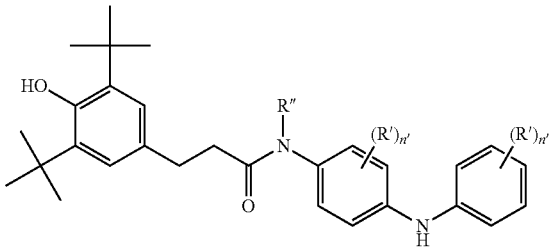

Wherein each R' is independently H, a C1-C10 alkyl, or styrene

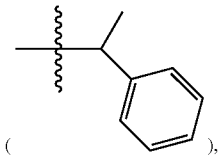

and n' is 1 or 2, and

R" is a C1-C10 alkyl,

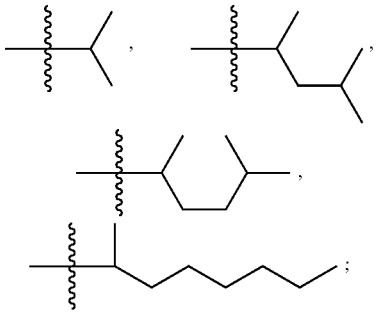

along with at least one first additive selected from the groups comprising of surface additives, performance-enhancing additives, and lubricant protective additives; and optionally ii) a second additive and/or a second antioxidant (or stabilizer) wherein examples of suitable second additives and antioxidants are as described herein. In another embodiment of the present disclosure, R" is a mixture of akyl chains,

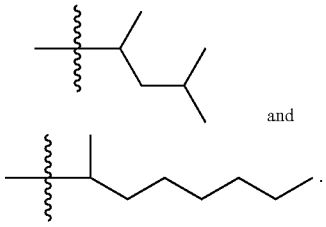

and

In one embodiment of the compound of Structure I, R' is H.

In another embodiment of the compound of Structure I, R' is a C4 alkyl (butylated). In another embodiment of the compound of Structure I, R' is a C8 alkyl (octylated).

In one embodiment of the compound of Structure I, R' is styrene.

In one embodiment, an additive with Structure I provided in the carrier oil or a bio solvent or bio-oil or biobased solution ranging from about 10 wt. % to about 90 wt. %, from about 15 wt. % to 65 wt. %, from about 20 wt. % to about 40 wt. %.

In one embodiment, the present disclosure relates to an additive composition comprising at least one minimally toxic antioxidant and at least one biobased multifunctional additive.

In one embodiment, the first antioxidants which are suitable for use in the compositions and methods of the present invention include but are not limited to: at least one antioxidant can be dual type moiety per molecule (DTMPM), a phenolic antioxidant, an aminic antioxidant, and mixtures thereof. The antioxidant can be supplied as a liquid solution in a biobased biodegradable solvent, bio-derived oils, or combinations thereof.

In another embodiment, the first antioxidants suitable to use in the composition and methods of the present invention include a mixture of compounds.

(Structure I)

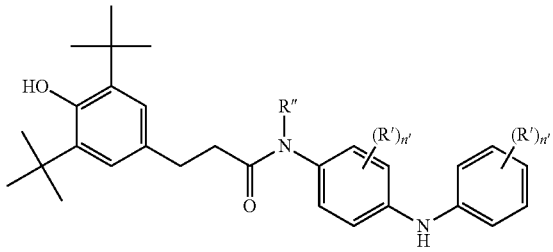

Wherein each R' is independently H, a C1-C10 alkyl, or styrene

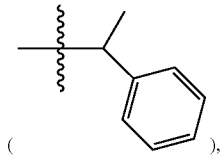

n' is 1 or 2, and wherein R" is a C1-C10 alkyl,

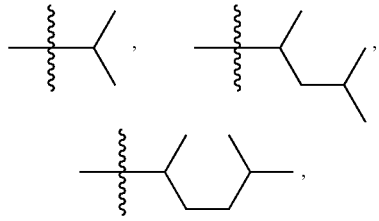

-continued

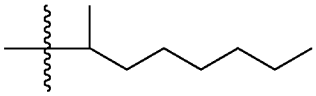

When R' is H and n=1, the Structure I is (Structure Ia)

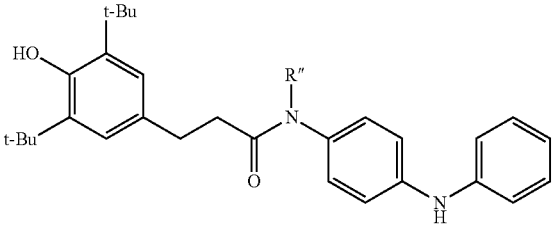

wherein R" is a C1-C10 alkyl,

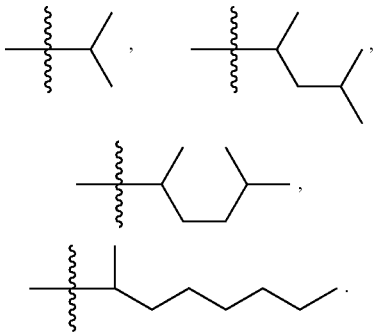

In another embodiment of the present disclosure, R" in Structure 1a is a mixture of the following alkyl chains:

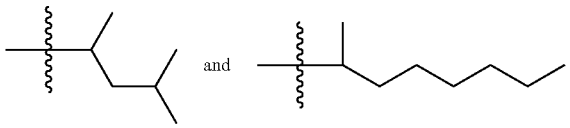

In another embodiment, non-limiting examples of antioxidants include liquid octylated/butylated diphenylamine, alkylated diphenylamine, aminic-phenolic antioxidants, natural antioxidants, or a mixture thereof.

In one embodiment of the invention, it is a mixture of the compound structure I and another compound selected from octylated/butylated diphenylamine, aminic-phenolic antioxidants, natural antioxidants 1:99, 10:90, 20:80, 30:70, 40:60, 50:50, 60:40, 70:30, 80:20, 90:10, or 99:1 by wt. %.

Yet another embodiment of the present invention is a composition that is a mixture of macromolecules, an additive represented by isomeric combinations possessing surface-protecting properties, including corrosion-inhibiting, rust-inhibiting, antiwear, and demulsifier properties as described in U.S. Pat. No. 11,578,285.

(Structure II)

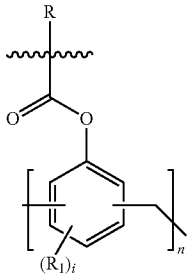

wherein R is H, $CH_3$, $OCH_3$, or a linear or branched $C_1$-$C_9$ alkyl chain, n is an integer from 1 to 100, or an integer from 1 to 50, or an integer from 1 to 25, or an integer from 1 to 15, or preferably an integer from 1 to 10; R is:

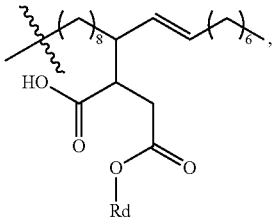

Rd is a C1-C24 linear or branched alkyl chain.

In another embodiment, the compound in Structure II is also a demulsifier to separate water and oil.

In another embodiment, the compound in Structure II is a corrosion inhibitor, rust inhibitor, antiwear, and demulsifier.

In one embodiment, the compositions include but are not limited to:

a. a first antioxidant (in the concentration range, from about 0.0001% to about 50%, from about 0.0005% to about 20%, from about 0.005% to about 10%, from about 0.05% to about 5%, or from about 0.01% to about 1%) and a multifunctional additive (Structure II) (in the concentration range, from about 0.0001% to about 50%, from about 0.0005% to about 20%, from about 0.005% to about 10%, from about 0.05% to about 5%, or from about 0.01% to about 1%) with a first additive selected from the group comprising a surface additive, a performance-enhancing additive, and a lubricant performance additive, for example, in amounts of from about 0.0005% to about 50%, from about 0.0001% to about 20%, from about 0.005% to about 10%, from about 0.05% to about 5% or from about 0.01% to about 1% by weight, based on the weight of lubricant to be stabilized.

b. the first antioxidant, a multifunctional additive (Structure II), and the first additive as described in a. and a second additive, for example, in concentrations of from about 0.0001% to about 50% by weight, about 0.0005% to about 20% by weight, about 0.001% to about 10% by weight, from about 0.01% to about 5% by weight, from about 0.05% to about 5% by weight, or from about 0.1% to about 1% by weight based on the overall weight of the lubricant to be stabilized.

c. the first antioxidant, a multifunctional additive, and the first additive as described in a. and optionally the second additive as described in b. and a second antioxidant, for example, a liquid octylated/butylated diphenylamine, pentaerythritol tetrakis(3-(3,5-di-tert-butyl-4-hydroxyphenyl) propionate), 2,4,6-Tris (4-hydroxy-3,5-di-tert-butyl benzyl)-1,3,5-trimethylbenzene, octadecyl3-(3,5-ditert-butyl-4-hydroxyphenyl) propanoate, 4-(2,4,4-trimethylpentan-2-yl)-N-[4-(2,4,4-trimethylpentan-2-yl)phenyl]aniline and octyl 3-[4-hydroxy-3,5-di(propan-2-yl)phenyl]propanoate, in the concentration range, from about 0.0001% to about 50%, from about 0.0005% to about 20%, from about 0.005% to about 10%, from about 0.05% to about 5% or from about 0.01% to about 1%) by weight, based on the weight of lubricant to be stabilized.

In yet another embodiment, the antioxidant compound of Structure I has significantly improved solubility in non-polar oils due to non-polar R' groups attached to the aromatic ring structures. The antioxidant compound of Structure I is therefore more soluble in non-polar oils than the antioxidant compound of Structure 1a. Examples of non-polar oils include, but are not limited to, mineral oils, group II oils, group III oils, and polyalphaolefin (PAO) oils.

In yet another embodiment, the first additive is a surface additive selected from the group consisting of (a) rust inhibitors, (b) corrosion inhibitors, (c) extreme pressure agents, (d) tackiness agents, (c) antiwear agents, (f) detergents and dispersants, defoamers, and (g) compounded oil.

In one embodiment, the first additive is a performance-enhancing additive selected from the group consisting of (a) pour-point depressants, (b) viscosity index modifiers, (c) emulsifiers, and (d) demulsifiers.

In one embodiment, the first additive is a lubricant protective additive selected from the group consisting of (a) oxidation inhibitors and (b) foam inhibitors.

In another embodiment, the composition further includes a second antioxidant that is minimally toxic and nonbioaccumulative, selected from the group consisting of amine antioxidants, octylated/butylated diphenylamine, octylated diphenylamine, phenolic antioxidants, sulfurized organic compounds, organo-borate compounds, phosphite and phosphate antioxidants, copper compounds and zinc dithiophosphate.

Yet another embodiment is a multifunctional additive compound comprising a mixture of biobased macromolecules with Structure II represented by a mix of isomers replacing at least four additives in the formulation.

In another embodiment, the compound having Structure II replaces corrosion inhibitor, rust inhibitor, antiwear, and demulsifier.

In one embodiment, the compound having structure II is mixed with a compound selected from corrosion inhibitors, rust inhibitors, demulsifiers, antiwear additives, or a mixture thereof.

In another embodiment, the bio-content of the compound in Structure II is >75% according to C14 analysis using ASTM D6186 method allowing to assess the content of natural product in the compound.

In yet another embodiment, an additive having Structure II reduces the number of chemicals from four to one used in the formulation promoting chemical use reduction efficiency (CURE) to lesser pollution.

In one embodiment, the multifunctional additive with Structure II is biobased.

In another embodiment, the additive with structure II is designed to perform four different additive activities in lubricants.

In yet another embodiment, the multifunctional additive having Structure II is minimally toxic, $LC_{50}$>100 mg/L, and has low bioaccumulation in aquatic organisms estimated by the EPIWIN method (4.1).

In another embodiment, the antioxidant additive with Structure I is minimally toxic, $LC_{50}$>100 mg/L, and has low bioaccumulation in aquatic organisms estimated by the EPWIN method (4.1).

In one embodiment, the lubricant is selected from the group consisting of bio-oils, bio-based oils, bio-derived oils, biolubricant oils, synthetic oil, oil, or a mixture thereof, are biodegradable, minimally toxic, and no bioaccumulation.

In one embodiment, a compound of Structure II is the first additive selected from the group comprising a surface additive, a performance-enhancing additive, and a lubricant performance additive, for example, in amounts from about 0.0005 wt. % to about 50 wt. %, from about 0.0001 wt. % to about 20 wt. %, from about 0.005 wt. % to about 10 wt. %, from about 0.05 wt. % to about 5 wt. % or from about 0.01 wt. % to about 1 wt. % by weight, based on the weight of lubricant to be stabilized.

In one embodiment, an additive with Structure II provided in the carrier oil or a bio solvent or bio-oil or biobased solution ranging from about 10 wt. % to about 90 wt. %, from about 15 wt. % to 65 wt. %, from about 20 wt. % to about 40 wt. %.

In one embodiment, the additive composition can comprise up to 50 wt. % antioxidants, for example, from about 1 wt. % to about 60 wt. %, and a further example, from about 10 wt. % to about 50 wt. %.

In another embodiment, the additive composition can comprise up to 50 wt. %, for example, from about 1 wt. % to about 60 wt. %, and as a further example, from about 10 wt. % to about 50 wt. % of a multifunctional additives.

In another embodiment, the additive composition can comprise from about 0.005 wt. % to 5 wt. %, from about 0.01 wt. % to about 2 wt. %, and as a further example, from about 0.05 wt. % to about 3 wt. % of an antifoaming additive.

In one embodiment, the additive composition can comprise from about 0.01 wt. % to 10 wt. %, from about 0.05 wt. % to about 5 wt. %, and as a further example, from about 0.5 wt. % to about 2 wt. % of a pourpoint depressant additive.

In another embodiment, the additive composition can comprise from about 0.01 wt. % to 10 wt. %, for example, from about 0.05 wt. % to about 5 wt. %, and as a further example, from about 0.5 wt. % to about 2 wt. % of extreme pressure additive.

In another embodiment, the additive composition can comprise from about 0.01 wt. % to 10 wt. %, for example, from about 0.05 wt. % to about 5 wt. %, and as a further example, from about 0.5% wt. % to about 2 wt. % of a color-sensitive dye additive.

In one embodiment, a method of forming a lubricant or mixture of oils includes the step of combining a lubricant or combination of oils to create a lubricant composition consisting essentially of:

a) a biolubricant or a mixture of lubricants, or a bio-oil, bio-based oil, bio-derived oil, an oil with biodegradability, nonbioaccumulative, and minimally toxic, or a combination of oils with biodegradability, minimally toxic and nonbioaccumulative;

b) an antioxidant component includes a first antioxidant represented by a mixture of the following compounds:

(Structure I)

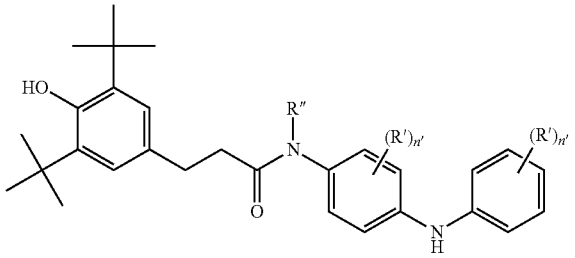

Wherein each R' is independently H, a C1-C10 alkyl, or styrene

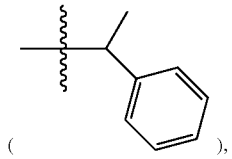

n' is 1 or 2, and wherein R" is a C1-C10 alkyl

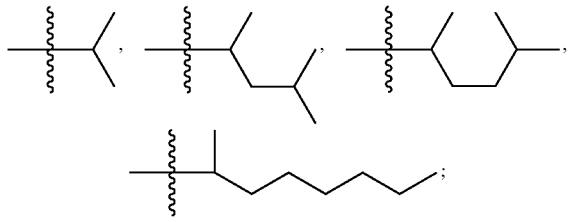

and c) a multifunctional additive represented by a mixture of isomeric mixtures of the following compounds:

(Structure II)

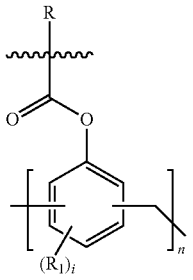

wherein R is H, $CH_3$, $OCH_3$, or a linear or branched C1-C9 alkyl chain, n is an integer from 1 to 100, or an integer from 1 to 50, or an integer from 1 to 25, or an integer from 1 to 15, or preferably an integer from 1 to 10; R is,

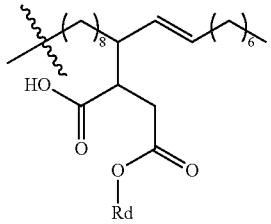

Rd is a C1-C24 linear or branched alkyl chain d) at least one first additive selected from the group consisting of: i) a surface additive; ii) a performance-enhancing additive; and iii) a lubricant protective additive; wherein the concentration of the first antioxidant is from about 0.05 wt. % to about 5 wt. % of the lubricant composition, and the concentration of a multifunctional additive is from about 0.05 wt. % to about 5 wt. % of the lubricant composition, and the concentration of the first additive is from about 0.05 wt. % to about 5 wt. % of the lubricant composition.

In another embodiment, the first antioxidant is represented by a mixture of the following compounds:

(Structure 1a)

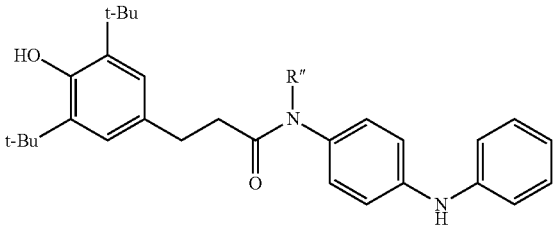

wherein R" is a C1-C10 alkyl,

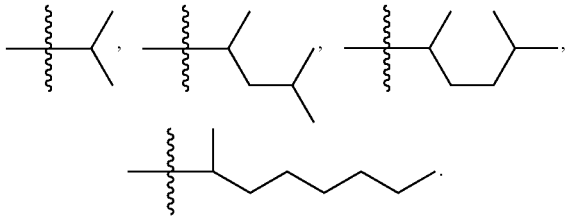

In another embodiment, R" in Structure 1a is a mixture of the following alkyl chains:

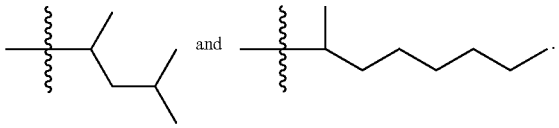

In another embodiment, the method includes the first additive is a surface additive selected from the group consisting of (a) rust inhibitors, (b) corrosion inhibitors, (c) extreme pressure agents, (d) tackiness agents, (e) antiwear agents, (f) detergents and dispersants and (g) compounded oil.

In one embodiment, the method includes the first additive is a performance-enhancing additive selected from the group consisting of (a) pour-point depressants, (b) viscosity index modifiers, (c) emulsifiers, and (d) demulsifiers.

In yet another embodiment, the method includes the additive is a lubricant protective additive selected from the group consisting of (a) oxidation inhibitors and (b) foam inhibitors.

In one embodiment, the method of making involves the composition further includes a second antioxidant that is minimally toxic and nonbioaccumulative, selected from the group consisting of amine antioxidants, phenolic antioxidants, and the ratio of the first and second antioxidants is 1:99, 10:90, 20:80, 30:70, 40:60, 50:50, 60:40, 70:30, 80:20, 90:10, or 99:1.

In another embodiment, the method includes the lubricant is selected from the group consisting of bio-oils, bio-based oils, bio-derived oils, biolubricant oils, synthetic oil, oil, or a mixture thereof, are biodegradable, minimally toxic, no bioaccumulation.

In some embodiments, the lubricant replaces petroleum-based lubricants used in bearing oils, steam turbine oils, gas turbine oils, hydro turbine oils, compressor oils, tractor fluids, drilling oils, elevator oils, and hydraulic fluids. In some embodiments, the lubricant has a viscosities ranging from 22 cSt to 680 cSt at 40° C. In some embodiments, the lubricant has a viscosity of 22, 32, 36, 68, 100, 150, 220, 320, 460 or 680 cSt at 40° C. The most common viscosities for turbine oils are 32, 46, 68, and 100 cSt at 40° C.

Lubricants are categorized in a number of ways. One of the common methods is by the constituent of the base oil, namely mineral, synthetic, or bio-oil. Mineral oil is derived from crude oil, is produced to arrange qualities associated with the oil's refining process. The American Petroleum Institute (API) has categorized the first three groups (Group I, Group II and Group III) to mineral oil based on their processing conditions. Group IV is categorized to synthetic oils specifically for polyalphaolefins (PAO) which are made through synthetically generated hydrocarbons with an olefinic tail formed through a polymerization process involving ethylene gas. They have a better viscosity index and excellent low- and high-temperature performance, superior oxidation stability, and lower volatility. Their properties are far superior compared to mineral oils. In another embodiment of the present invention, the lubricant that replaces petroleum-based lubricants viscosity ranges from 10 cSt to 700 cSt, preferably from 20 to 100 cSt, lubricants with 32 cSt, 46 cSt, 68 cSt, and 100 cSt viscosity, all at 40° C.

The compositions and methods of the present invention generally provide increased shelf life, increased oxidative resistance, enhanced performance, and improved quality to materials, such as lubricants and lubricant oils and fuels. Other examples include-biolubricants and biolubricant oils, and biofuel such as biodiesel. In general, it is believed that because of the synergy of the corrosion inhibitors with the additives, the compositions described herein have superior performance to meet industrial needs. The lubricant comprising a set of additives exhibits several key functions such as corrosion inhibition, detergency, viscosity modification, antiwear performance, dispersant properties, cleaning, and suspending ability. The disclosed compositions, in general, provide the superior performance of lubricants in high-temperature applications due to high-performance additives that are thermally stable at high temperatures with enhanced oxidation resistance.

In certain embodiments, the present invention of lubricant comprises base oil and a suitably formulated additive package. These packages are also for aftermarket products to enhance the performance of lubricants and fuel. Other additive packages are designed for preparing lubricants and fuel by adding to base stock oils; petroleum-based (Group I-V oils), bio-based, bio-oils, and gasoline, diesel, and biodiesel.

In yet another embodiment, the present invention is a method of improving an additive package composition comprising combining the composition compounds of Structure I and Structure II; and at least one additive selected from the group consisting of i) a surface additive, ii) a performance-enhancing additive, and iii) a lubricant protective additive.

In yet another embodiment, a method of improving an additive package composition includes combining the composition with compounds Structure I and II additives, one or more of an antioxidant, a metal deactivator, rust inhibitor, copper corrosion inhibitor, viscosity index modifier, pour point depressant, dispersing agent, detergent, an extreme-pressure, a dye, seal swell agents, demulsifiers, and an anti-foaming additive; each additive present in the range from about 0.005 wt. % to about 5 wt. % and carrier oil. A suitable carrier from petroleum, biobased bio-oil dissolves all additives and is easy to pour into a lubricant or a fuel. The ratio between combined additives in the present invention and carrier oil range from 1:99 to 99:1 wt. %, 5:95 wt. %, 10:90 wt. %, 20:90 wt. %, 30:70 wt. %, 40:60 wt. %, 50:50 wt. %, 60:40 wt. %, 70:30 wt. %, 80:20 wt. %, 90:10 wt. %, and 95:5 wt. %.

In another embodiment, an additive package is formulated for different lubricant applications including, but not limited to, one additive package wind turbines, another one for hydro turbines, steam, turbines, for hydraulics fluid, metal working fluids, compressor oils, pump oils, drill oils, two-stroke engine oils, saw oils, automotive, aviation and marine lubricants and other Industrial applications.

In one embodiment, the carrier oil for the additive package is a petroleum distillate, Aromatic D200, Aromatic D200ND, or Steposol C25 or C42.

Comparison of Environmentally Acceptable Lubricants with Mineral Turbine Oil Lubricants In one embodiment, the formulated EAL oil is compared with mineral oils and is presented below in Table 3. Formulated EALs were tested according to the American Society for Testing and Materials (ASTM) testing protocols for oil viscosity (ASTM D445), viscosity index (ASTM D 2270), density (ASTM D 4052), pour point (ASTM D97), flashpoint (ASTM D92), total acid number (ASTM D974), air release (ASTM D3427), water separability (ASTM D1401), rust control (ASTM D665B), oxidation control (ASTM D943 and ASTM D2272) and compared with product specifications for turbine mineral oils by Shell, Mobil products listed in Table 3 along with turbine specifications by GE for petroleum-based products. The formulated oil was tested for its toxicity using the Organization for Economic Cooperation and Development (OECD) 201, OECD 202, and OECD 203 test methods. Bioaccumulation was estimated based on U.S. EPA. (Estimation Programs Interface Suite for Microsoft Windows, v4.11) for EAL's additive compounds with Structures I and II used in EAL. Biodegradability was based on suppliers' reported values of base oils.

In one embodiment, a close examination of data listed in Table 3 for key performance indicators such as oxidative stability (ASTM D 943 and D 2272), Total acid number (ASTM D943), rust-inhibiting capacity (ASTM D665), etc. show the properties of EALs are comparable to mineral oils and provide environmental benefits whereas mineral oils do not. The formulated EAL is equally suitable for lubricant oil for many applications, including bearings, hydro, gas, wind turbines, and hydraulics.

In one embodiment, the composition of the biolubricant comprising safer additives and biodegradable biobased base oils results in performance similar to or better than petroleum-based lubricants. Mineral oil lubricants containing petroleum base oil and additives do not comply with EAL requirements for a better environment.

In another embodiment of the present invention, the performance EAL is formulated with safer and biobased additives and oxidatively stable biobased base oils to replace toxic lubricants to help the environment.

It will be apparent to those skilled in the art that various modifications and variations can be made to the lubricant composition of the present invention, comprising a biodegradable oil with a set of safer additives for decreasing friction between moving surfaces as well as the method for lubricating a surface employing such a composition without departing from the spirit or scope of the invention. It is intended that these modifications and variations of this invention are to be included as part of the invention, provided they come within the scope of the appended claims and their equivalents.

In one embodiment of the present invention, an extreme pressure additive, (for example, Polysulfides, di-tert dodecyl, TSP 20 from Arkema) was added to the composition of the formulated oil with a role to decrease wear of the parts exposed to very high pressures.

Example 1. Additive Package: An additive package was prepared using 5.1 g by weight of antioxidant DTMPM (Structure Ia); 1 g of multifunctional MCIN additive (Structure II), 0.25 g of defoamer (FoamBan130B from Munzing), 1.5 g of pour-point depressant (PD-90, Functional Products) in 12.1 g of naturally derived biodegradable Steposol solvent C-25 (methyl ester containing a blend of methyl caprylate/caprate methyl ester, Stepan). About 20 g of sample was prepared.

Example 2. Similar to an additive package in Example 1, an additive package was prepared by adding 2.58 g antioxidant DTMPM (Structure Ia); 0.52 g of multifunctional MCIN additive (Structure II), 0.13 g by weight defoamer (FoamBan130B from Munzing), 0.77 g by weight of pour-point depressant (PD-90, Functional Products), and 0.7 g of extreme pressure additive TPS 20 (Arkema) in 6 g of naturally derived biodegradable Steposol solvent C-25 (methyl ester containing a blend of methyl caprylate/caprate methyl ester, Stepan) in making about 10 g of the product.

Example 3. In example 2, 0.78 g extreme pressure additive, TPS 20 additive was added.

Example 4. In example 2, 1.3 g of extreme pressure additive, TPS 20 was added.

Example 5. 10 g of an additive package in Example 1 was blended with 60 g of an estolide oil (BT 22, Biosynthetic, 150 cSt) and heated at 50 to 60° C. for an hour and then added 230 g of polyalphaolefin (EL26, Novvi, 26 cSt) to make a 300 g of formulated oil, and was mixed thoroughly. The pour point of the oil according to ASTM D 97 was −33° C., four ball wear test (ASTM D4172) 0.34 mm, Rotating Pressure Vessel Oxidation test (ASTM 2272) at 150° C. was 1476 min, measured viscosity (ASTM D445) at 40° C. was 46 cSt and other ASTM test results are in Table 3.

In another embodiment of the present invention, when the extreme pressure additive was added to the formulation (Polysulfides, di-tert dodecyl, TSP 20 from Arkema), the oxidative stability of the formulated product (Example 3) improved significantly. The oxidative stability was measured according to ASTM 2272 method and increased from 1474 minutes to 1716 minutes. When 0.75 weight % of TSP was added (example 4) to the formulated oil. At a higher treat level, the oxidative stability was dropped to 1361 minutes. It was further decreased to 1219 minutes when the extreme level was increased to 1.5 weight %. The oxidative stability is dependent on the interplay between free sulfur and active sulfur at the operation temperature. The efficient treatment level was at 0.375 by weight. The copper corrosion inhibiting capacity of the formulated oil deteriorated due to the presence of higher concentrations of extreme pressure additives due to competing surface activities between them.

Biodegradable lubricant base oils and synthetic-biodegradable oils are commercially available from different sources, e.g. Novvi, Biosynthetic, Croda, Lexolube (Zschimmer & Schwarz), Ineos, Exxon-Mobil, with different viscosity grades. Because of the non-polar nature of polyalpha olefins (PAOs), polar additives are not soluble. To overcome this, ester-based oils, including estolides 10%-30% by weight are used in the formulation while using PAOs. The viscosity of the formulated product was adjusted to a specific value of 32 cSt, 46 cSt, or 68 cSt to meet OEM needs. The comparative data for petroleum turbine oils were collected readily from the technical data sheet or commercial literature from the manufacturers. Table 3 shows EAL data comparable to the performance of petroleum products for turbine applications with the added benefit of environmental properties.

The composition of the present invention is applicable use of environmentally acceptable lubricants in hydro, gas, steam, wind turbines, and other industrial applications where environmental concerns need to be mitigated, preferably where operations are required to protect the environment from pollution.

TABLE 3

Comparison of EAL and Petroleum Lubricant comparison for Hydro turbine

| TABLE-3 | | | Petroleum | | |
|---|---|---|---|---|---|
| | | | Mobil DTE* | GE Turbine Specifications | EAL Polnox |
| Properties | Method | Units | medium | GEK3268H | EAL |
| Viscosity @40° C. | ASTM D 445 | cSt | 44.5 | 28.5-35.2 | 46.8 |
| Viscosity @100° C. | ASTM D445 | cSt | 6.9 | | 8 |
| Viscosity Index | ASTM D2270 | | 98 | 95 | 142 |
| Color | ASTM D1500 | | — | 2 | light yellow |

TABLE 3-continued

Comparison of EAL and Petroleum Lubricant comparison for Hydro turbine

| TABLE-3 | | | Petroleum | | |
|---|---|---|---|---|---|
| | | | Mobil DTE* | GE Turbine Specifications | EAL Polnox |
| Properties | Method | Units | medium | GEK3268H | EAL |
| Density | ASTM D4502 | kg/m$^3$ | 850 | | 866 |
| PourPoint | ASTM D97 | ° C. maximum | −15 | 10/−12 | −20 |
| Flash Point | ASTM D92 | ° C. | 221 | 215 | 234 |
| Total Acid Number | ASTM D94 | mg KOH/g | — | 0.2 (max) | 0.1 |
| Air Release | ASTM D3427 | min | — | 5 (max) | 5.6 |
| Water demulsibility | ASTM D1401 | min | 15 | | 12 |
| Rust Control | ASTN D665B | | Pass | Pass | Pass |
| Copper Corrosion | ASTM D130 | | — | 1B | 1A |
| Foam | ASTM D892 | | — | 50/0, 50/0, 50/0 | 50/0, 50/0, 50/0 |
| Oxidation Control-TOST | ASTM D943 | hours | 3700 | 5000 | 5200 |
| Oxidation Test RPVOT | ASTM D 2272 | minutes | — | 500 | 1476 |
| EAL Properties | | | NO | NO | YES |
| Biodegradability | | | — | — | Yes* |
| Toxicity | OECD 201 | 72 hours | — | — | Pass, LC50 >250 mg/l |
| | OECD202 | 48 hours | — | — | Pass, LC50 >500 mg/l |
| | OECD203 | 96 hours | — | — | Pass, LC50 >500 mg/l |
| Bioaccumulation | | | | | NO |
| Additives | above OECD tests | | | | Pass |

*technical data sheet from the manufacturer, Searched on the internet

INCORPORATION BY REFERENCE; EQUIVALENTS

The teachings of all patents published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

What is claimed is:

1. A lubricant composition comprising:

a) a bio-oil;

b) a first antioxidant represented by a mixture of the following compounds:

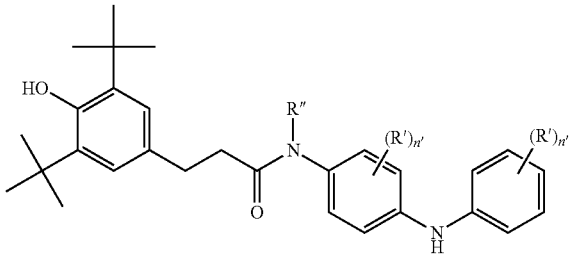

wherein each R' is independently H, a C1-C10 alkyl, or styrene

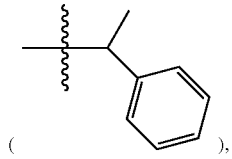

and n' is 1 or 2;

wherein R" is a C1-C10 alkyl

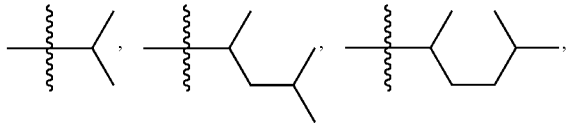

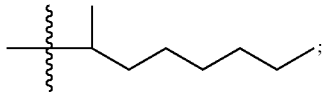

c) a multifunctional additive represented by

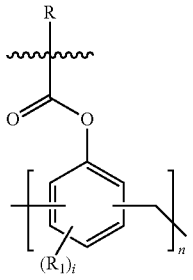

wherein $R_1$ is H, $CH_3$, $OCH_3$, or a linear or branched $C_1$-$C_9$ alkyl chain; i=1, 2, or 3; n is an integer from 1 to 15;

R is

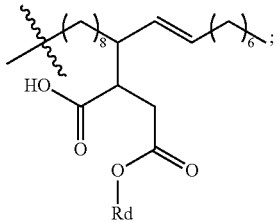

and

Rd is a C1-C24 linear or branched alkyl chain; and d) at least one first additive selected from the group consisting of:

i) a surface additive;

ii) a performance-enhancing additive; and iii) a lubricant protective additive;

wherein the concentration of the first antioxidant is from about 0.05 wt. % to about 5 wt. % of the lubricant composition, and the concentration of the first additive is from about 0.05 wt. % and to about 5 wt. % of the lubricant composition.

2. The lubricant composition of claim 1, wherein the first additive is a surface additive selected from the group consisting of (a) a rust inhibitor, (b) a corrosion inhibitor, (c) an extreme pressure agent, (d) a tackiness agent, (e) an antiwear agent, (f) a detergent, (g) a dispersant, (h) a defoamer, and (i) a compounded oil.

3. The lubricant composition of claim 1, wherein the first additive is a performance-enhancing additive selected from the group consisting of (a) a pour-point depressant, (b) a viscosity index modifier, (c) an emulsifier, and (d) a demulsifier.

4. The lubricant composition of claim 1, wherein the first additive is a lubricant protective additive selected from the group consisting of (a) an oxidation inhibitor and (b) a foam inhibitor.

5. The lubricant composition of claim 1, wherein the composition further includes a second antioxidant selected from the group consisting of an amine antioxidant, octylated/butylated diphenylamine, octylated diphenylamine 2,6 ditertiary butyl phenol, 2,2'-thiobis(6-tert-butyl-p-cresol), and a zinc dialkyldithiophosphates (ZDDP).

6. The lubricant composition of claim 1, wherein the multifunctional additive is a corrosion inhibitor, a rust inhibitor, an antiwear, and a demulsifying agent.

7. The lubricant composition of claim 1, wherein the multifunctional additive is biobased.

8. The lubricant composition of claim 1, wherein the kinematic viscosity of the lubricant composition is from 20 to 700 cSt at 40° C.

9. The lubricant composition of claim 1, wherein the lubricant composition comprises:

i) a surface additive;

ii) a performance-enhancing additive; and iii) a lubricant protective additive.

10. The lubricant composition of claim 1, wherein the surface additive is a defoamer.

11. The lubricant composition of claim 1, wherein the performance-enhancing additive is a pour-point depressant.

12. The lubricant composition of claim 1, wherein the first antioxidant is represented by a mixture of the following compounds:

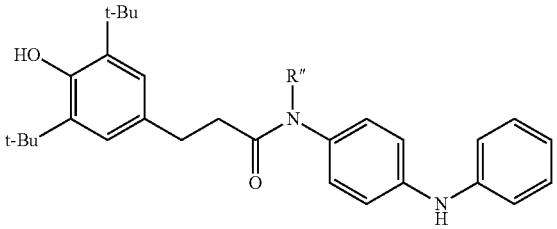

wherein R" is a C1-C10 alkyl

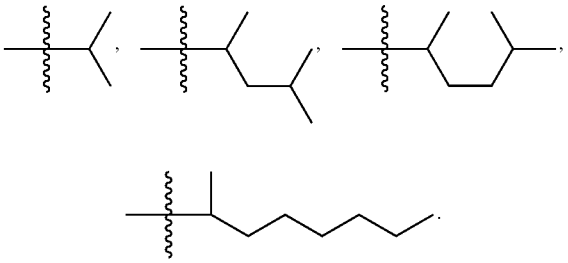

13. A method of forming a lubricant composition, the method comprising combining:

a) a bio-oil;

b) a first antioxidant represented by a mixture of the following compounds:

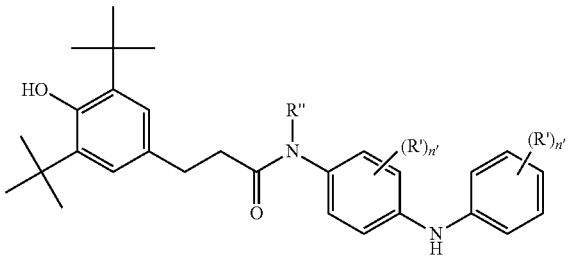

wherein each R' is independently H, a C1-C10 alkyl, or styrene

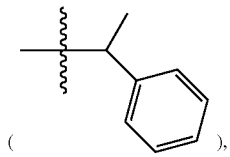

and n' is 1 or 2;

wherein R" is a C1-C10 alkyl

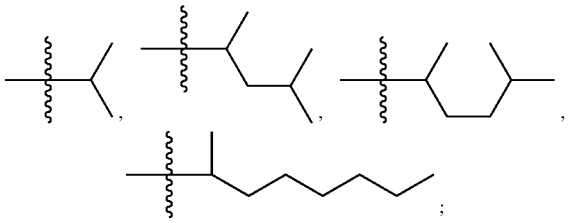

and c) a multifunctional additive represented by a mixture of isomeric mixtures

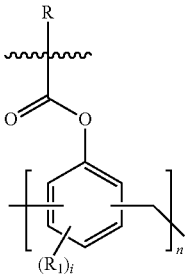

wherein R is H, $CH_3$, $OCH_3$, or a linear or branched $C_1$-$C_9$ alkyl chain; I=1, 2, or 3;

n is an integer from 1 to 15;

R is

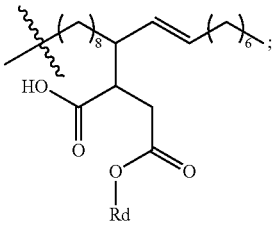

and

Rd is a C1-C24 linear or branched alkyl chain; and d) at least one first additive selected from the group consisting of:

i) a surface additive;

ii) a performance-enhancing additive; and iii) a lubricant protective additive;

wherein the concentration of the first antioxidant is from about 0.05 wt. % to about 5 wt. % of the lubricant composition, and the concentration of the first additive is from about 0.05 wt. % and to about 5 wt. % of the lubricant composition.

14. The method of claim 13, wherein the first additive is a surface additive selected from the group consisting of (a) a rust inhibitor, (b) a corrosion inhibitor, (c) an extreme pressure agent, (d) a tackiness agent, (e) an antiwear agent, (f) a detergent, (g) a dispersant, (h) a defoamer, and (i) a compounded oil.

15. The method of claim 13, wherein the first additive is a performance-enhancing additive selected from the group consisting of (a) a pour-point depressant, (b) a viscosity index modifier, (c) an emulsifier, and (d) a demulsifier.

16. The method of claim 13, wherein the additive is a lubricant protective additive selected from the group consisting of (a) an oxidation inhibitor and (b) a foam inhibitor.

17. The method of claim 13, wherein the composition further includes a second antioxidant selected from the group consisting of aminic antioxidants and phenolic antioxidants.

18. The method of claim 13, wherein the ratio of the first antioxidant to the second antioxidants is from 1:99 to 99:1.

19. The method of claim 13, wherein the first antioxidant is represented by a mixture of the following compounds:

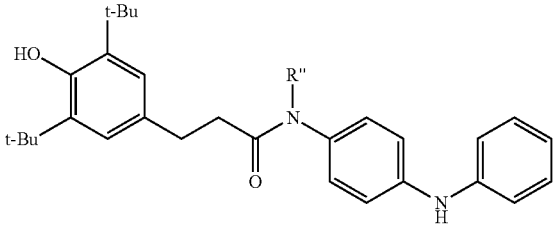

wherein R" is a C1-C10 alkyl

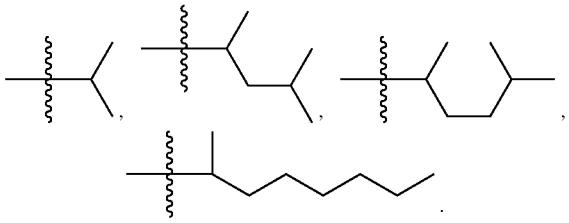

20. The method of claim 13, wherein the first antioxidant R" is represented by a mixture of the following alkyl chains:

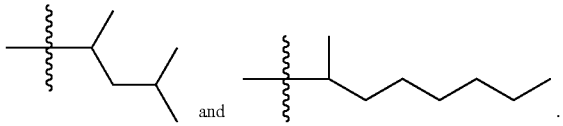

21. The lubricant composition of claim 1, wherein the lubricant composition is a bearing oil, a steam turbine oil, a gas turbine oil, a hydro turbine oil, a compressor oil, a tractor fluid, a drilling oil, an elevator oil, or a hydraulic fluid.

22. The lubricant composition of claim 21, wherein the lubricant composition is a turbine oil.

23. The lubricant composition of claim 21, wherein the lubricant composition is a hydro turbine oil.

24. The lubricant composition of claim 21, wherein the lubricant composition is a hydraulic fluid.

25. A kit for forming a lubricant, the kit comprising:

a) a carrier oil having dissolved therein:

i) a first antioxidant represented by a mixture of the following compounds:

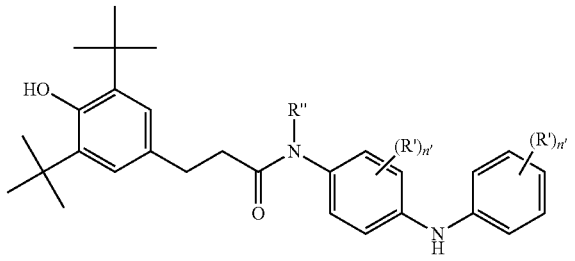

wherein each R' is independently H, a C1-C10 alkyl, or styrene

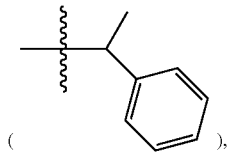

and n' is 1 or 2;

wherein R" is a C1-C10 alkyl

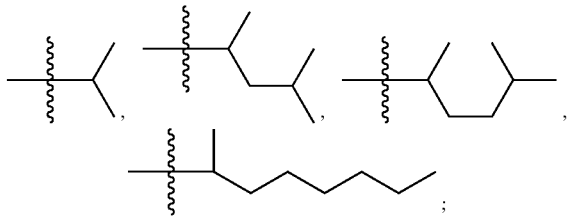

ii) a multifunctional additive represented by

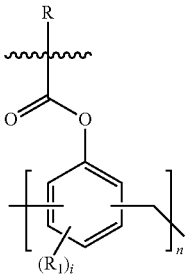

wherein: $R_1$ is H, $CH_3$, $OCH_3$, or a linear or branched $C_1$-$C_9$ alkyl chain; i=1, 2, or 3; n is an integer from 1 to 15;

R is

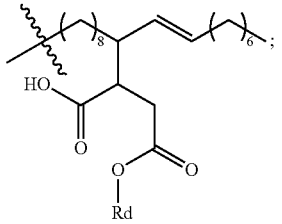

and

Rd is a C1-C24 linear or branched alkyl chain; and iii) at least one first additive selected from the group consisting of:

1) A surface additive;

2) A performance-enhancing additive; and

3) A lubricant protective additive.

26. The kit of claim 25, wherein each of the at least one first additive is from about 0.05 wt. % to about 25 wt. % of the kit.

27. The kit of claim 25, wherein the ratio of the carrier oil to all compounds dissolved therein is from 90:10 to 10:90.

28. The kit of claim 25, wherein the carrier oil is petroleum distillate, petroleum oil, methyl esters of fatty acids of vegetable oils, or a blend of methyl laurate and myristate methyl ester.

29. The kit of claim 25, wherein the first antioxidant is represented by a mixture of the following compounds:

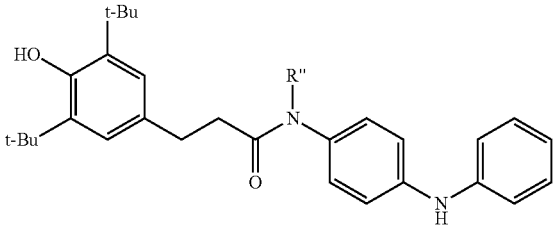

wherein R" is a C1-C10 alkyl

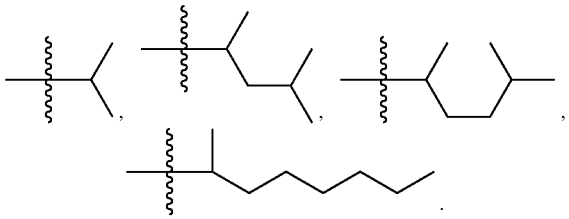

* * * * *